US006022508A

United States Patent [19]

Berns

[11] Patent Number: 6,022,508

[45] Date of Patent: Feb. 8, 2000

[54] METHOD OF POWDER METALLURGICAL MANUFACTURING OF A COMPOSITE MATERIAL

[75] Inventor: Hans Berns, Bochum, Germany

[73] Assignees: Koppern GmbH & Co., KG, Germany, Germany; Erasteel Kloster Aktiebolag, Sweden, Sweden

[21] Appl. No.: 08/875,879

[22] PCT Filed: Feb. 16, 1996

[86] PCT No.: PCT/SE96/00208

§ 371 Date: Aug. 6, 1997

§ 102(e) Date: Aug. 6, 1997

[87] PCT Pub. No.: WO96/26298

PCT Pub. Date: Aug. 29, 1996

[30] Foreign Application Priority Data

Feb. 18, 1995 [DE] Germany ..... 195 05 628

[51] Int. Cl.[7] ..... B22F 3/12; B22F 7/02

[52] U.S. Cl. ..... 419/6; 419/10; 419/12; 419/13; 419/14; 419/19; 419/23; 419/48; 419/49; 419/38

[58] Field of Search ..... 419/10, 12, 13, 419/14, 19, 23, 38, 48, 49

[56] References Cited

U.S. PATENT DOCUMENTS 5,723,799 3/1998 Murayama et al. ..... 75/232
5,835,841 11/1998 Yamada et al. ..... 428/546

FOREIGN PATENT DOCUMENTS 0 128 360 12/1984 European Pat. Off. ..... B22F 9/12
0 209 132 1/1987 European Pat. Off. ..... C22C 32/00
0 515 944 12/1992 European Pat. Off. ..... C22C 1/05
92 14853 9/1992 WIPO ..... C22C 33/02
94 17939 8/1994 WIPO ..... C22C 33/02

OTHER PUBLICATIONS

Patent Abstracts of Japan, vol. 10, No. 323, M–531, Abstract of JP, A, 61–130404 (Toyota Central Res & Dev Lab Inc.), Jun. 18, 1986 Patent Abstracts of Japan, vol. 8, No. 52, C–213, Abstract of JP, A, 58–207340 (Sumitomo Denki Kogyo K.K.), Dec. 2, 1983.

Int'l Journal of Refractory & Hard Metals, vol. 6, No. 3, Sep. 1987, (Quebec, Canada), Champagne B., "Properties of WC–Co/Steel Composites", pp. 155–160, see p. 155, col. 1, line 24–p. 156, col. 2, line 15; p. 157, col. 1, line 7—col. 1, line 28, p. 159, col. 1, p. 7—p. 160, col. 2, p. 31.

*Primary Examiner*—Daniel J. Jenkins
*Attorney, Agent, or Firm*—Kilpatrick Stockton LLP

[57] ABSTRACT

In a method of powder metallurgical manufacturing of a composite material containing particles in a metal matrix, said composite material having a high wear resistance in combination with a high toughness, the powder particles (I) of a first powder of a first metal or alloy having a high content of hard particles (HT) dispersed in the matrix of said first powder particles, are dispersed in a second powder consisting of particles (II) of a second metal or alloy having a low content of hard particles dispersed in the matrix of said second powder particles, wherein a mutual contact between the hard particles and/or between the particles of said first powder is substantially avoided, and the mixture of said first and second powders is transformed to a solid body through hot compaction.

26 Claims, 2 Drawing Sheets

FIG. 1a
FIG. 1b
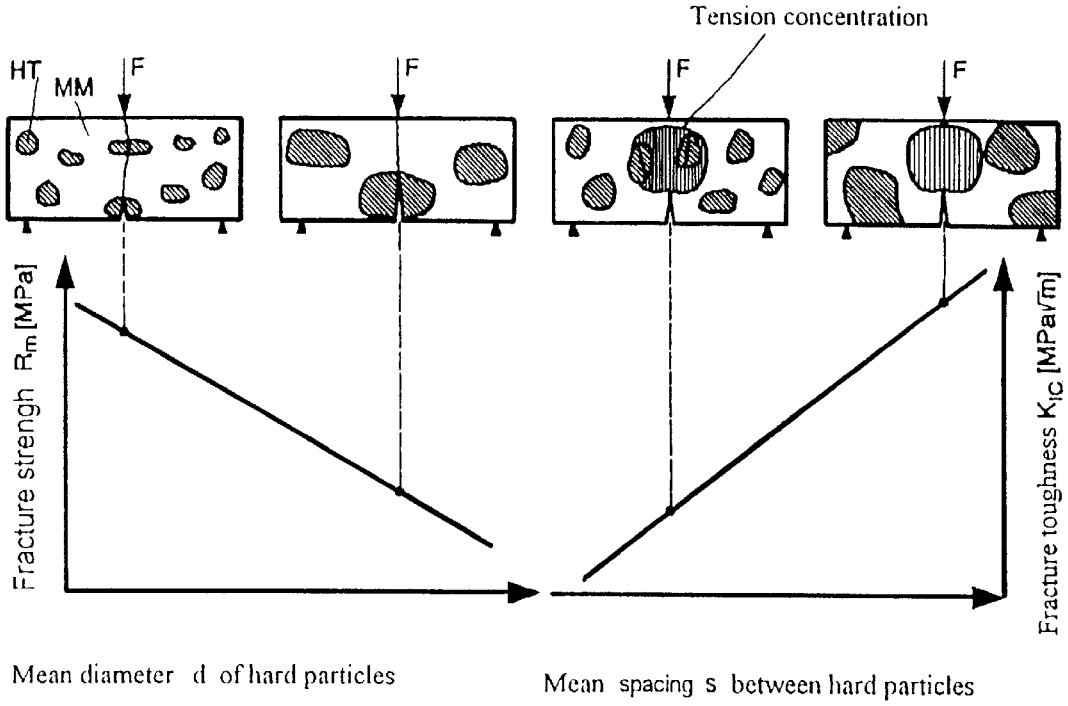
FIG. 2a
FIG. 2b
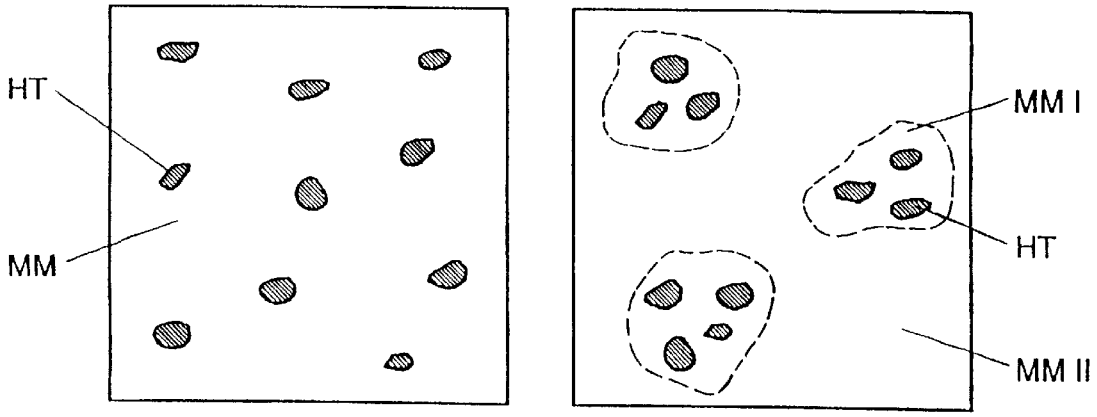

METHOD OF POWDER METALLURGICAL MANUFACTURING OF A COMPOSITE MATERIAL

TECHNICAL FIELD

The present invention relates to a method of powder metallurgical manufacturing of a composite material containing particles in a metal matrix, said composite material having a high wear resistance in combination with a high toughness.

BACKGROUND OF THE INVENTION

Wear resistant metal material conventionally consist of a solidified metal matrix in which hard particles such as borides, carbides, nitrides or intermetallic phases appear as inclusions. The wear resistance and the fracture toughness in such materials are usually highest when the hard particles are evenly dispersed in the metal matrix and when a net-like distribution is avoided. At a given amount of evenly dispersed hard particle the fracture strength of the material is reduced as the size of the hard particles is raised, while the fracture toughness is increased. This can be explained in the following way with reference to the accompanying FIGS. 1*a* and 1*b*. When the material is subjected to a tension or bending load, F, cracks are initially formed in the brittle hard particles, FIG. 1A. These cracks are the greater, the greater the hard particles are, and propagate already at a low tension to fracture; in other words the fracture strength decreases as the sizes of the hard particles are raised. At a given content of hard particles, however, the mean spacing between the hard particles increases with the sizes of the hard particles, FIG. 1*b*. Therefore, a plastic zone can be established in the metal matrix in front of a crack, avoiding further cracks in the hard particles, wherein the fracture toughness will increase in relation to the spacing between the hard particles. At a given content of hard particles and consequently at a given wear resistance, an improved fracture toughness is accompanied by an impaired fracture strength.

BRIEF DISCLOSURE OF THE INVENTION

It is the purpose of the present invention to provide a composite material containing particles in a metal matrix, wherein the material will have a high wear resistance in combination with a high fracture strength and fracture toughness. This can be achieved by a method defined in the characterizing part of the accompanying claim 1. Further characteristic features of the invention are disclosed in the subsequent claims and in the following description, wherein reference will be made to the accompanying drawings.

BRIEF DESCRIPTION OF THE DRAWINGS

FIGS. 1*a* and 1*b* schematically describe the relationship between the sizes of the hard particles and the mechanical properties fracture strength and fracture toughness for a dispersion structure at a given content of hard particles, FIGS. 2*a* and 2*b* schematically illustrate a one step and a two step dispersion structure, respectively, at equal volume contents of hard particles.

DETAILED DESCRIPTION OF THE INVENTION

According to the invention, the well-known dispersion structure of FIG. 2*a*, which is obtained by a one step procedure, wherein the hard particles HT in a metal matrix MM is replaced by the dispersed structure achieved by a two step procedure, FIG. 2*b*. The two step dispersion structure of the invention, FIG. 2*b*, contains regions with a dense dispersion of fine, hard particles in a first metal matrix MM I, wherein these regions which are rich of fine, hard particles in their turn appear as a dispersion of inclusions in a second metal matrix MM II, which is essentially lacking hard particles. The two step dispersion micro structure of the invention has a high fracture strength because of its small hard particle diameters in the first metal matrix MM I and also a high fracture toughness because of the large spacing between the hard particles in the second matrix MM II.

In the following, the advantages of the micro structure obtained by the two step dispersion in comparison with the one step dispersion micro structure will be explained with reference to an embodying example. At the manufacturing of the material according to the example, there was used as starting materials, gas atomised steel powders having alloy compositions shown in Table 1.

TABLE 1

Chemical composition of used steel powders

| | Content in weight-% | | | | | |
|---|---|---|---|---|---|---|
| Metal Powder | C | Cr | Mo | W | Co | V |
| MP | 1.28 | 4.2 | 5.0 | 6.4 | 8.5 | 3.1 |
| MP I | 2.3 | 4.2 | 7.0 | 6.5 | 10.5 | 6.5 |
| MP II | 0.4 | 5.0 | 1.4 | — | — | 1.0 |

The steel alloys also contained about 0.4% Si, about 0.3% Mn, and nitrogen and other impurities in amounts normal for high speed steels, balance iron.

Figure 3:
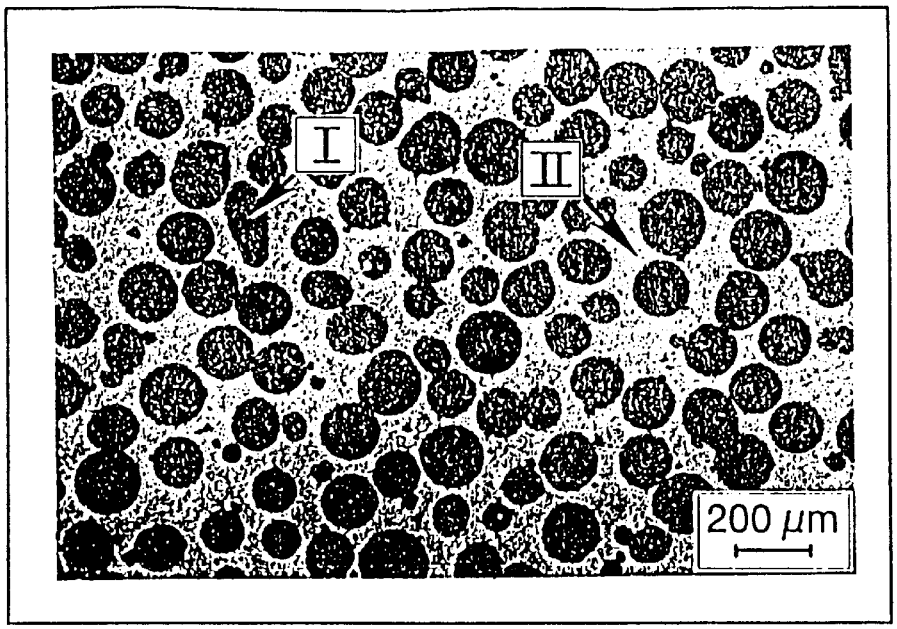
FIG. 3 shows a two step dispersion structure made from a mixture of a first powder I and a second powder II.

Test materials were made by hot isostatic pressing, and the materials were hardened and tempered to a hardness of about 900 HV30. The conventional one step dispersion structure was formed by metal powder MP and contained a fine dispersion of carbides having a mean diameter d of about 1 $\mu$m, representing a volume content of about 16%. The two step dispersion structure of the invention according to FIG. 3 was made from a mixture of metal powder MP I and MP II. In powder MP I there is formed a fine dispersion of carbides having a mean diameter $d_1$ of about 1 $\mu$m, representing a volume content of about 30%. It is mixed with powder MP II, which is essentially lacking carbides, such that the carbide content in the test samples amounted to about 16 vol.-%. The structure regions formed of powder MP II contained about 2 vol.-% of fine carbides, and can be referred to as almost void of carbides, while the regions formed from powder MP I contained about 30 vol.-% of carbides, in other words they were rich of carbides. In order to achieve a dispersion of MP I particles in the bulk of MP 11 particles, the mean powder particle diameters $D_I$ and $D_{II}$ of the powders MP I and MP II, respectively, shall be selected such that the ratio $D_I/D_{II}$ is increased with increasing volume content of powder MP I and such that it will lie above the border curve in FIG. 4, and preferably in the shadowed (obliquely lined) area A above the curve C in FIG. 4. In the example embodying the invention, indicated by E in FIG. 4, there was chosen a ratio $D_I/D_{II}=5$.

The test material having a dispersed structure made conventionally in one step and the dispersion structure made according to the invention in two steps had, when subjected to static bending, a fracture strength of about 3000–3200 MPa. In wear experiments, wherein the materials were subjected to wear against bound flint grains of mesh size 80 under a load of 1.31N/mm$^2$, the wear resistance of both the materials was measured to between $7.5\times10^4$ and $8\times10^4$. Both the test materials in other words exhibited at an average about equal fracture strengths and wear resistances. The fracture toughness of the test material made in two steps according to the invention, however, was measured to 15 MPa/m which is more than 40% over the value for the conventional material made in one step, which was measured to only 10.5 MPa/m.

Two die inserts were made of the test material of the invention, made in two steps, and the die inserts were shrunk into a cold forging tool for forming screws from a steel wire. In comparison to the conventional high speed steel S 6-5-2, which is being used according to prior art, the quantity of screws which was manufactured in the tool was increased with a factor 8 when working an annealed wire and with a factor 6.5 when working a cold drawn wire.

Figure 4:
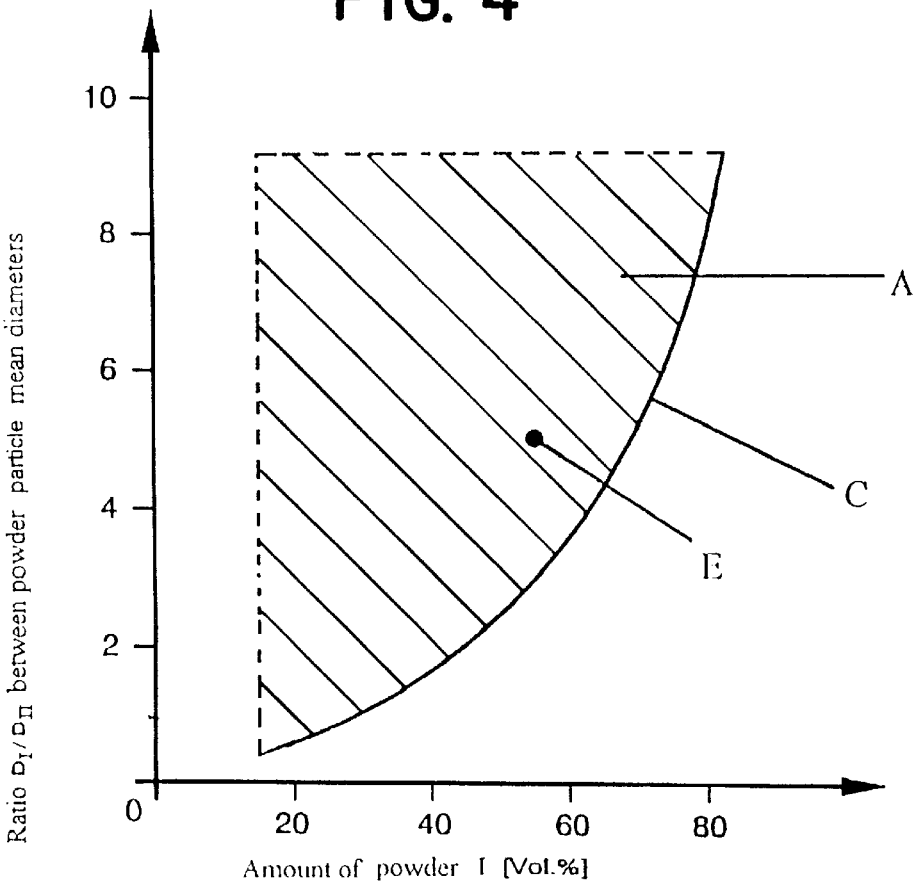
FIG. 4 is a graph diagram of the ratio between the mean diameters of a first and a second powder versus the volume content of the first powder I.

I claim:

1. A method of powder metallurgical manufacturing of a composite material containing particles in a metal matrix, said composite material having a high wear resistance in combination with a high toughness, comprising:

dispersing in a first matrix comprising powder particles (I) of a first powder of a first metal or alloy a first content of hard particles (HT) to form a first dispersion, dispersing the first dispersion in a second matrix comprising powder particles (II) of a second powder of a second metal or alloy a second content of hard particles dispersed in the second matrix of the second powder particles, wherein the second content is lower than the first content and wherein the ratio ($D_I/D_{II}$) between the mean diameter ($D_I$) the powder particles of the first powder and the mean diameter ($D_{II}$) of the powder particles of the second powder is selected such that a proportion of said first powder in a mixture of said first and second powders lies in the shadowed area in the graph in the accompanying FIG. 4 and that contact between the hard particles, between the hard particles and the first powder, and between the particles of the first powder is essentially avoided, and transforming the mixture to a solid body through hot compaction.

2. The method according to claim 1, characterized in that the mean diameter of the hard particles is less than a fourth of the mean diameter of the particles of said first powder.

3. The method according to claim 1, characterized in that the powder particles of the first powder contain more than 10 vol.-% of hard particles, and that the powder particles of the second powder contain less than 10 vol. -% of hard particles.

4. The method according to claim 3, characterized in that the powder particles of the first powder contain 10–20 vol.-% of hard particles, and that the powder particles of the second powder contain less than 5 vol.-% of hard particles.

5. The method according to claim 1, characterized in that the powder particles of the first powder contain more than 20 vol.-% of hard particles, and that the powder particles of the second powder contain less than 10 vol.-% of hard particles.

6. The method according to claim 5, characterized in that the powder particles of the second powder contain less than 8 vol.-% of hard particles.

7. The method according to claim 1, characterized in that the hard particles comprise any compound, phase or element belonging to the group of compounds, phases or elements consisting of carbides, nitrides, borides, oxides, intermetallic phases and silicon.

8. The method according to claim 7, characterized in that the carbides, nitrides and/or borides essentially consist of compounds of carbon, nitrogen and/or boron on one hand, and one or more of the elements belonging to the group consisting of Fe, Ni, Cr, Mo, W, V, Nb, Ti, Ta, B, Si on the other hand.

9. The method according to claim 7, characterized in that the oxides essentially consist of compounds of oxygen and one or more of the elements belonging to the group consisting of Ca, Mg, Al, Si, Cr, Ti, Zr, Y, Ce and La.

10. The method according to claim 1, characterized in that the first and second metals or alloys are aluminum alloys and that the hard particles to at least a significant degree are formed by primary or eutectic precipitation of silicon.

11. The method according to claim 1, characterized in that the hard particles in the powder particles are established at solidification of droplets of said first and second metals or alloys to form powder particles or during a heat treatment subsequent to said solidification.

12. The method according to claim 11, characterized in that at least the first powder is prepared by a process including gas atomization of the molten first metal or alloy to form particles having substantially spherical shape, that the powder particles of said first and second powders, prior to mixing them with each other, have different particle size distributions and that the mean diameter ($D_I$) of said first powder is larger than the mean diameter ($D_{II}$) of said second powder.

13. The method according to claim 12, characterized in that the second powder is prepared by a process including gas atomization of the molten second metal or alloy to form particles having substantially spherical shape.

14. The method according to claim 1, characterized in that the powder particles are shaped by agglomeration of finer powder particles to adopt the approximate shapes of compact spheres.

15. The method according to claim 1, characterized in that the powder particles are shaped by agglomeration of finer powder particles to adopt compact polyhedric shapes.

16. The method according to claim 11, characterized in that at least one of said first and second powders is prepared by a process including sieving of a bulk of powder to provide a powder having selected sizes.

17. The method according to claim 1, characterized in that the ratio between the mean diameters of the particles of the first and second powders satisfy the expression $$1.6 \le \frac{D_I}{D_{II}} \le 30,$$

$D_I$ is the mean diameter of the particles of the first powder, and $D_{II}$ is the mean diameter of the particles of the second powder.

18. The method according to claim 17, satisfying the expression $$2 \le \frac{D_I}{D_{II}} \le 10.$$

19. The method according to claim 18, satisfying the expression $$3 \le \frac{D_I}{D_{II}} \le 8.$$

20. The method according to claim 1, characterized in that said first and second metals or alloys consist substantially of any of the elements belonging to the group consisting of Fe, Ni, Co, Cu and Al and that at least said first alloy is alloyed to provide harder particles and desired features.

21. The method according to claim 1, characterized in that the hot compaction is carried out through any of the following techniques: vacuum sintering, pressure sintering or hot isostatic pressing.

22. The method according to claim 1, characterized in that the first metal or alloy is an alloy which contains, express in weight-%, more than totally 1% of C, N, B, and O; 0–2 Mn, 0–3 Si, and more than totally 15% of metals having a high affinity to C, N. B, and O to form carbides, nitrides, borides, and/or oxides, said metals including Cr, Mo, W, V, Nb, Ta, Zr, Ti, and Al, and that the second metal or alloy contains less than totally 1% of C, N, B, and O, 0–2 Mn, 0–3 Si, and less than totally 15% of said metals having a high affinity to C, N, B, and O, balance in both said first and said second alloy icon, cobalt and nickel and incidental impurities and accessory elements in normal amounts.

23. The method according to claim 22, characterized in that said first alloy contains more than totally 1.5% of C, N, B, and O, and totally more than 18% of said metals having a high affinity to C, N, B, and O.

24. The method according to claim 23, characterized in that said first alloy contains more than totally 2.0% of C, N, B, and O, and totally more than 22% of said metals having a high affinity to C, N, B, and O.

25. The method according to claim 22, wherein the second alloy contains less than totally 0.9% of C, N, B, and O, and less than totally 14% of said metals having a high affinity to C, N, B, and O.

26. The method according to claim 25, wherein the second alloy contains less than totally 0.6% of C, N, B, and O, and less than totally 10% of said metals having a high affinity to C, N, B, and O.

* * * * *